US005628480A

United States Patent [19]

Vrsecky et al.

[11] Patent Number: 5,628,480

[45] Date of Patent: May 13, 1997

[54] SWITCH BLADE ROLLING DEVICE

[75] Inventors: Pavel Vrsecky, Chodov; Jiri Walter, Prague, both of Czech Rep.

[73] Assignee: Eco Production Vresova, SPOL. S.R.O., Vresovà, Czech Rep.

[21] Appl. No.: 553,568

[22] PCT Filed: Nov. 15, 1993

[86] PCT No.: PCT/CZ93/00026

§ 371 Date: Nov. 27, 1995

§ 102(e) Date: Nov. 27, 1995

[87] PCT Pub. No.: WO94/28246

PCT Pub. Date: Dec. 8, 1994

[30] Foreign Application Priority Data

May 25, 1993 [CZ] Czech Rep. ..... 991-93

[51] Int. Cl.[6] ..... E01B 7/00

[52] U.S. Cl. ..... 246/453; 246/430

[58] Field of Search ..... 246/430, 435 R, 246/442, 449, 448, 452, 453

[56] References Cited

U.S. PATENT DOCUMENTS 5,390,881 2/1995 Benenowski et al. ..... 246/453
5,501,418 3/1996 Humphrey et al. ..... 246/453

FOREIGN PATENT DOCUMENTS 389851 3/1990 European Pat. Off. .
495160 10/1991 European Pat. Off. .
1056641 5/1959 Germany .
4223095 1/1994 Germany .

*Primary Examiner*—Mark T. Le
*Attorney, Agent, or Firm*—Notaro & Michalos P.C.

[57] ABSTRACT

A switch blade rolling device has a suspended rolling support on which the switch blade is moved, a body provided with a hook, side parts, a transverse end wall with an end opening and a bottom transverse wall with a bottom opening. The clamping claw is anchored in the end opening and the elastic support is screwed into the bottom opening. The free end of an oscillating lever is supported at the top on the elastic support and is mounted in the longitudinal direction with an oscillating lever bolt between side parts. The oscillating lever carries two rollers on roll bolts. The first roller is arranged above the elastic support and is mounted in the longitudinal direction with an oscillating lever bolt between side parts. The oscillating lever carries two rollers on roll bolts. The first roller is arranged above the elastic support and the second roller is arranged between the oscillating lever bolt and the first roller. At the same time, the axle base of the roller is smaller than the width of the switch blade foot. The distance between the inner edge of the switch blade foot and the surface of the second roller in the position where the switch blade is located on the blade support lies between 0 and 50 mm, preferably between 1 and 5 mm.

5 Claims, 1 Drawing Sheet

SWITCH BLADE ROLLING DEVICE

FIELD AND BACKGROUND OF THE INVENTION

The invention concerns a switch blade rolling device of the type having a rolling support.

Various devices for supporting a railroad switch blade are known, including those with a rolling support. The main purpose in most new devices in this area is to reduce the handling force needed for switching, and reducing or eliminating the need for periodically lubricating said device.

According to German patent DE 361444, the switch blade is carried on a free rolling cylinder. Before the blade comes to a stock rail, the cylinder moves down from a higher part of a supporting plate. The switch blade seats with its full load on slide chairs. Then the movement of the switch blade finishes with a full translation force needed. When the switch blade begins to move back, an even greater force is needed.

In U.S. Pat. No. 1,599,733, the switch blade moves above a horizontally oriented member, rolling on a resiliently mounted roller. The clearance between the blade and sliding chairs is adjustable. The clearance does not change during all the movement, so that the switch blade is seated down on the slide chairs at the same time the load from an approaching wheel of a railroad vehicle is applied. The sudden seating of the switch blade causes undesirable impacts, such as kick bounces.

In German patent DE 1056641, the switch blade moves on a plurality of rollers, mounted in one block which is resiliently carried in a housing. The housing is connected to the stock rail foot by a bracket and clamping claw. The movement of the switch blade occurs under a constant upward force from rollers, which " . . . is adjustable to a predetermined height and to a horizontal position." The block with rollers is closely mounted in its housing and sealed. In this way a cavity is created, which, disadvantageously can fill with water through an aeration opening and, upon freezing, eliminates the resilient function of the device.

Also a group of East German patents (Nos. DD 56536, DD 61558, DD 64069, DD 66638 and DD 67140) shows devices having switch blades resiliently carried and transported above a longitudinal member. Said member is created in the form of a lever of the second kind, where during the transport of the switch blade over said member towards the stock rail, the upward force decreases. This decrease can cause the switch blade to seat on slide chairs before it finishes the movement to the stock rail. In a physical embodiment of the design, the upward force changes only slightly, which is insufficient for reliable adjustment of the seating moment of the blade using only the stock rail. The specifications of these patents describe all the movement of the blade as provided in a position slightly lifted above the slide chairs. Thus, kick bounces after the sudden seating of the switch blade on the slide chairs are not eliminated.

The above mentioned East German patents disclose that the longitudinal member is connected (by bolts or by welding), by means of a transverse member, to the slide chairs which are mounted on sleeper. This support system creates new forces among the sleeper, the slide chairs and the rail, which forces were not previously considered, and so the devices are easily damaged or require more frequent repairs. The devices according to the above-mentioned DD patents require complicated installation, due to welding or due to dismounting of existing parts from the rail-sleeper unit.

According to published German application DE-OS 3420505, a switch blade is known, which moves over a special slide chair, rolling on at least two spheres, which are carried in a ball-system housing. After moving downward from the last sphere, the switch blade seats on the slide chairs with its full load. Then, a very large transport force is needed for finishing the movement of the switch blade to the stock rail.

Also the device according to published European patent application EP 0389851 is known, where an upward force on the switch blade is applied continuously during its movement between the two end-positions. The switch blade seats on slide chairs slightly before coming to the stock rail. However, the device is very large and heavy.

SUMMARY OF THE INVENTION

A primary object of the invention is to provide improved switch blade moving means of this kind while reducing or eliminating the disadvantages described above.

According to the invention, a switch blade rolling device consists of a body provided with a hook, a pair of side parts, a transverse end wall with an opening and a bottom transverse wall with a bottom opening. A clamping claw is anchored in the end wall opening and an elastic support is screwed into the bottom opening. A free end of an oscillating lever is supported at the top of the elastic support and is mounted in the longitudinal direction with an oscillating lever bolt between the side parts. The oscillating lever carries two rollers on a pair of roller bolts. The first roller is positioned above the elastic support and the second roller is positioned between the oscillating lever bolt and the first roller. An axle base of the rollers is smaller than the width of the switch blade foot. The distance between the inner edge of the switch blade foot and the surface of the second roller, in the position where the switch blade is located by the stock rail, lies between 0 and 50 mm, and is preferably between 1 and 5 mm.

It is advantageous when a line connecting the oscillating lever bold and the bolt of the second roller is inclined, in an upward direction towards the stock rail, by an angle of 15° from a vertical line passing through the oscillating lever bolt. When the elastic support is not depressed, the oscillating lever bolt is preferably situated at least as high as the upper surface of the elastic support. The upper surface of the oscillating lever is in the longitudinal direction slightly rounded by the free end of said oscillating lever.

The elastic support can be a bolt-type stem connected to a dish-shaped member biased by a spring, which is covered by a cup-shaped member.

The elastic support can be a bolt-type stem connected to a dish-shaped housing containing a spring, which is covered by a cup-shaped tappet.

DETAILED DESCRIPTION OF THE PREFERRED EMBODIMENTS

Figure 1:
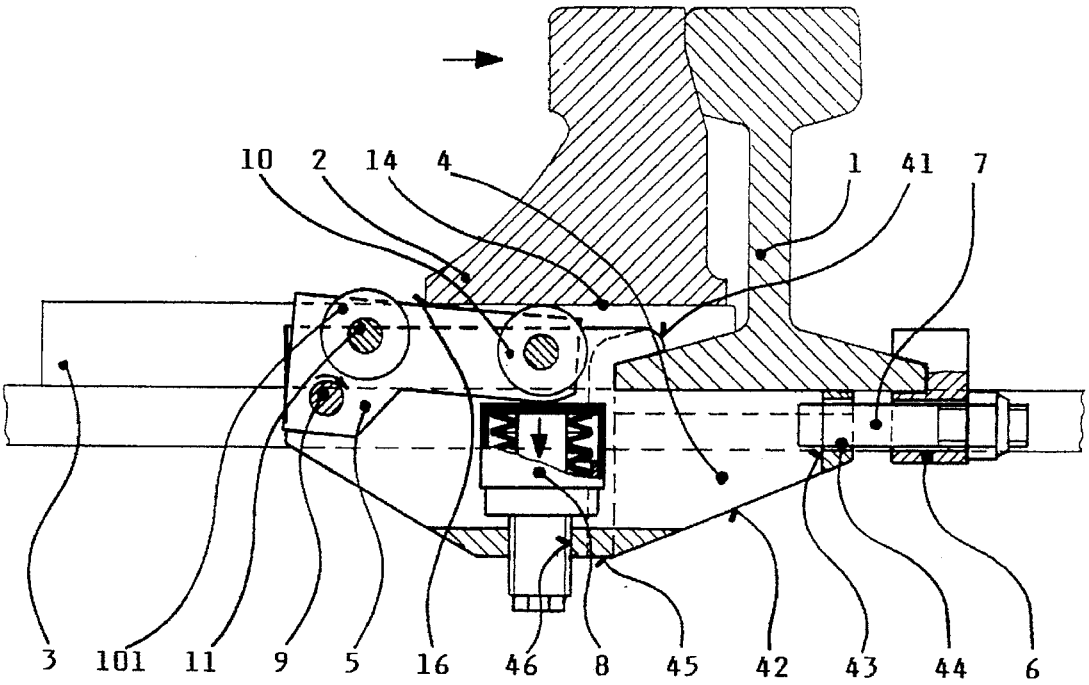
FIG. 1 is a vertical longitudinal sectional view of the switch blade rolling device with the switch blade transported to the stock rail.
Figure 2:
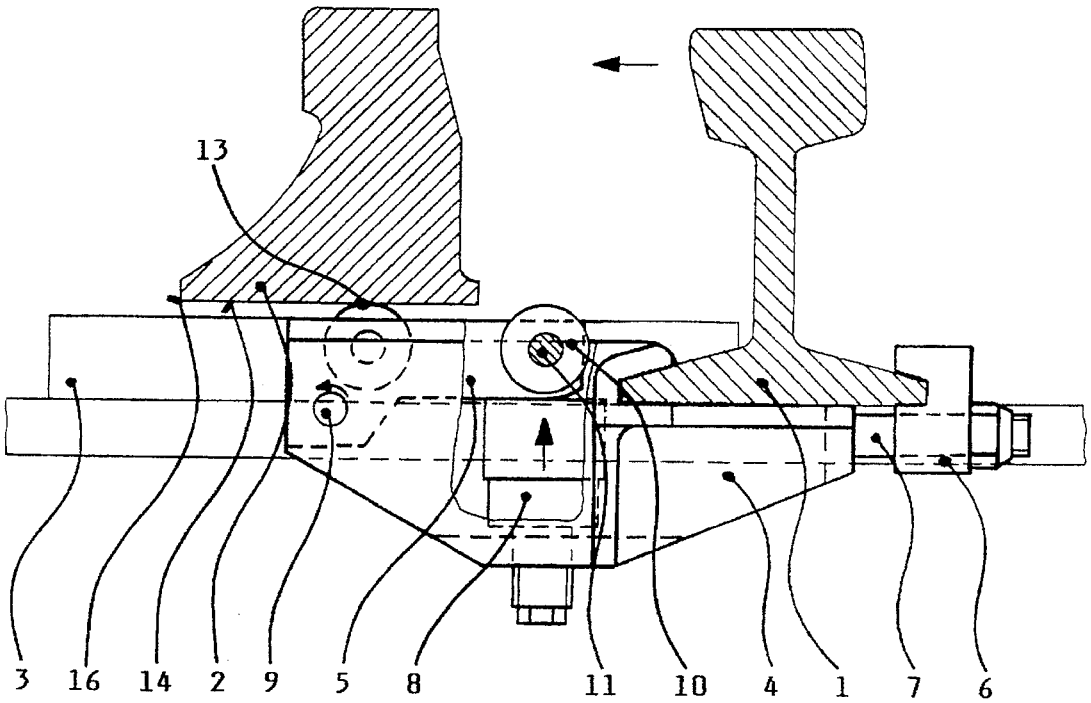
FIG. 2 is a vertical longitudinal sectional view of the switch blade transported away from the stock rail.

Referring to the FIGS. 1 and 2, a body 4 of the device consists of side parts 42, transverse end wall 43 having an end wall opening 44, and a bottom transverse wall 45 having a bottom opening 46. The body 4 is attached to a stock rail 1 by hook 41 and clamping claw 6. The clamping claw 6 is anchored by anchoring bolt 7 secured with a nut through the end wall opening 44 of the end wall 43. Elastic support 8 is screwed into the bottom opening 46.

The free end of oscillating lever 5 is seated on the top of elastic support 8, which top is a cup-shaped tappet, covering a spring. The oscillating lever 5 is situated between and connected to the two side parts 42 by oscillating lever bolt 9. The oscillating lever 5 carries two rollers 10, 101 on roll bolts 11. First roller 10 is situated adjacent a free end of the oscillating lever 5, above the elastic support 8. Second roller 101 is situated adjacent the oscillating lever bolt 9. The rollers 10, 101 have self-lubricating bearings.

Switch blade 2, has switch blade foot 14 seated on contact point 13 of the second roller 101. When the switch blade 2 is positioned adjacent the stock rail 1, the switch blade foot 14 sits only on the first roller 10 and, consequently, on the slide chair 3. In this position, the distance between the inner edge 16 of the switch blade foot 14 and the surface of the second roller 101 is 5 mm.

In the other terminal position, where the switch blade 2 is located apart from the stock rail 1, the switch blade foot 14 seats only on the second roller 101.

In operation, starting with the switch blade 2 apart from stock rail 1, the switch blade is seated on the second roller 101. As the movement begins, the blade 2 is lifted strongly by a force from the elastic support 8. During the movement of the switch blade 2 towards the stock rail 1, and after the inner edge 16 of the switch blade foot 14 leaves the second roller 101, the switch blade foot 14 lowers on to the surface of the slide chair 3. Then, the movement of the switch blade 2 towards the stock rail 1 finishes under a slightly increased moving force, to overcome the effect of a portion of the weight of the blade 2 being placed on the slide chair 3. The normal force between slide chair 3 and the switch blade 2 is very small, since most of the force, or weight, of blade 2 is carried by the first roller 10.

A primary advantage of the invention is, compared to the known devices, that the forces carried by all of the parts of the switch blade rolling device according to the present invention are very small. As a result, the component parts and the device may be small and light-weight. Handling forces are low, and both mounting of the device and adjusting the device are very simple. The device can operate for a long period of time, reliably, without lubrication, and without suffering adverse effects from exposure to water, dust, etc.

The device can be used for rail switches of various gauges, various loading capacities and various speeds of railway vehicles. Due to the small dimensions it disturbs neither conventional rail service works, nor the mechanical packing of sleepers.

We claim:

1. A switch blade rolling device having a spring supported rolling transport unit for moving a switch blade having a switch blade foot and a switch blade foot inner edge between a first position adjacent a stock rail and a second position apart from the stock rail, the rolling device comprising:

a body comprising a pair of side parts, a transverse end wall having an end wall opening therethrough, a bottom transverse wall having a bottom opening therethrough, and a hook for engaging the stock rail;

a clamping claw anchored to the end wall at the end wall opening, the claw being provided for securing the body to the stock rail;

an elastic support fastened to the bottom transverse wall at the bottom opening, the support having a top surface;

an oscillating lever bolt connected between the pair of side parts;

an oscillating lever oriented longitudinally and pivotally mounted on the oscillating lever bolt between the pair of side parts, the lever having an upper surface and a free end supported by the elastic support;

a first roller rotatably connected to the oscillating lever at the free end and positioned above the elastic support;

a second roller rotatably connected to the oscillating lever between the oscillating lever bolt and the first roller, such that when the switch blade is in the first position, a distance between a surface of the second roller and the inner edge of the switch blade foot is between 0 and 50 mm.

2. A switch blade rolling device according to claim 1, wherein the distance between the inner edge of the switch blade foot and the surface of the second roller is between 1 and 5 mm.

3. A switch blade rolling device according to claim 1, wherein an imaginary line connecting the oscillating lever bolt and the second roller is upwardly inclined toward the stock rail at an angle of 15° from a vertical axis passing through the oscillating lever bolt.

4. A switch blade rolling device according to claim 1, wherein when the elastic support is not depressed, an axis of the oscillating lever bolt is positioned at a height at least equal to the top surface of the elastic support.

5. A switch blade rolling device according to claim 1, wherein the elastic support comprises a bolt stem connected to a dish-shaped member biased by a spring, the spring covered by a cup-shaped member.

* * * * *